United States Patent [19]

Dollison

[11] Patent Number: 4,919,205

[45] Date of Patent: Apr. 24, 1990

[54] FRICTION-REDUCING DEVICE

[76] Inventor: William W. Dollison, 4206 Alta Vista La., Dallas, Tex. 75229

[21] Appl. No.: 441,827

[22] Filed: Nov. 27, 1989

[51] Int. Cl.[5] ..... E21B 17/10

[52] U.S. Cl. ..... 166/241

[58] Field of Search ..... 166/241, 176; 175/325

[56] References Cited

U.S. PATENT DOCUMENTS

| | | | |
|---|---|---|---|
| 1,827,835 | 10/1931 | Black | 175/325 |
| 1,905,158 | 4/1933 | Craig et al. | 175/325 |
| 2,625,445 | 1/1953 | Ring | 166/241 |
| 4,372,622 | 2/1983 | Cheek | 175/325 |
| 4,612,987 | 9/1986 | Cheek | 175/325 X |
| 4,621,690 | 11/1986 | Klyne | 166/241 |

FOREIGN PATENT DOCUMENTS

| | | | |
|---|---|---|---|
| 8606784 | 11/1986 | PCT Int'l Appl. | 166/241 |
| 627230 | 10/1978 | U.S.S.R. | 175/325 |
| 1078021 | 3/1984 | U.S.S.R. | 166/241 |

*Primary Examiner*—Hoang C. Dang

*Attorney, Agent, or Firm*—Ross, Howison, Clapp & Korn

[57] ABSTRACT

A sucker rod coupling comprising a body member and a plurality of axially and circumferentially spaced roller assemblies adapted to reduce friction and wear between the body member and the well tubing in which it is used, each roller assembly further comprising a plurality of rollers linked by a chain, each roller being adapted to rotate within the chain while the chain revolves around a roller guide connected to the body member.

12 Claims, 1 Drawing Sheet

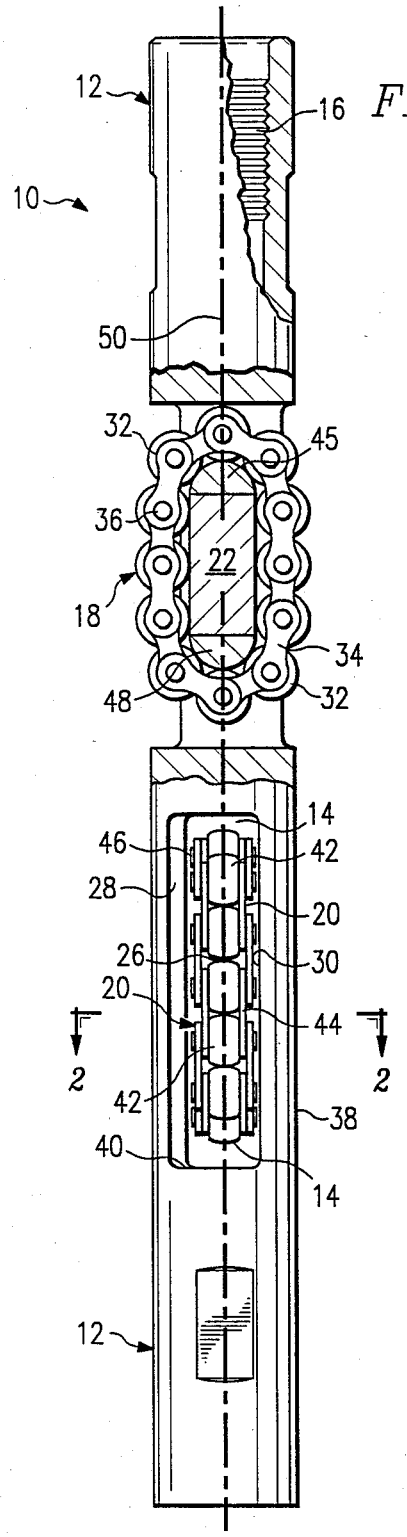
FIG. 1
FIG. 2
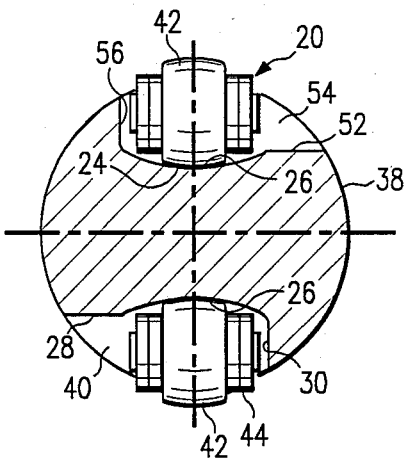
FIG. 3
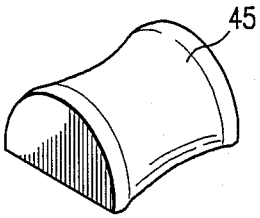

FRICTION-REDUCING DEVICE

TECHNICAL FIELD

This invention relates to friction-reducing devices for use in oil wells, and more particularly, to sucker rod couplings utilized with reciprocating rod pumps.

BACKGROUND ART

The use of rod guide couplings with rolling wheels is previously known for reducing friction, wiping and wear as the sucker rod string is reciprocated within production tubing in an oil well. The need for effective friction-reducing couplings for use with sucker rods, wireline tool strings, and other well tools is especially important in crooked or deviated well bores.

SUMMARY OF THE INVENTION

According to the present invention, a new coupling is provided that is significantly more efficient at reducing friction and wear between a reciprocating sucker rod string and well tubing than the wheeled rod guide couplings previously known.

According to a preferred embodiment of the invention, the friction-reducing coupling disclosed herein comprises a body member having a plurality of axially and circumferentially spaced roller assemblies, each of which is adapted to revolve around a centrally disposed roller guide within the body member. The roller assemblies are adapted to provide line contact between the coupling and the inside wall of the tubing. Each roller assembly preferably further comprises a plurality of hardened rollers connected by a roller chain. The circumferential edge of each roller is preferably contoured to conform to the tubing in which the string of sucker rods or other well tools operates. In operation, when the coupling of the invention is forced against the inside of the tubing wall, the roller assemblies provide pure rolling contact between the tubing and the coupling body member.

BRIEF DESCRIPTION OF THE DRAWINGS

The apparatus of the invention is further described and explained in relation to the following figures of the drawings wherein:

FIG. 1 is an elevation view, partially broken away and in section, depicting a preferred embodiment of the preferred sucker rod coupling of the invention;

FIG. 2 is a cross-sectional view of the sucker rod coupling of the invention taken along line 2—2 of FIG. 1; and FIG. 3 is a perspective view of a preferred roller guide slug for use in the the roller assembly of the sucker rod coupling of the invention.

Like reference numerals are used to indicate the same parts in all figures of the drawings.

DESCRIPTION OF THE PREFERRED EMBODIMENTS

Referring to FIG. 1, sucker rod coupling 10 of the invention preferably comprises body member 12 and roller assembly 18. Body member 12 is preferably made from a steel rod having a diameter about the same as or slightly greater than the diameter of the sucker rod with which coupling 10 is to be used. Body member 12 is preferably drilled and tapped at each end thereof to provide internal threads 16 for threaded engagement with the externally threaded ends of conventional sucker rod sections (not shown).

According to a preferred embodiment of the invention, body member 12 is further adapted to accommodate the installation of a plurality of axially and circumferentially spaced roller assemblies 18, 20. By use of the term "circumferentially spaced", reference is made to the fact that each roller assembly 18, 20 as shown in FIG. 1 is rotated 90 with respect to the other around centrally disposed longitudinal axis 50.

Roller assemblies 18, 20 preferably comprise a plurality of rollers 32, 42 joined by links 34, 44 and pins 36, 46. The construction of roller assemblies 18, 20 is desirably similar to that of conventional power transmission roller chains. Rollers 32, 42 are preferably case hardened steel to resist wear, and the outside edges of the rollers are preferably contoured to conform to the inside surface of the tubing.

As shown in FIG. 1, two axially spaced roller assemblies 18, 20, are installed in sucker rod coupling 10 with perpendicular circumferential spacing. When roller assemblies 18, 20 are installed in the sucker rod coupling, the outwardly facing edges of rollers 32, 42 extend radially beyond the outside surface of body 12 so that rollers 32, 42 can establish line contact with the inside wall of the tubing. Each roller assembly preferably extends radially beyond the external surface of body member 12 a sufficient distance that roller assemblies 18, 20 contact the tubing wall to prevent rubbing between body member 12 and the tubing wall in every radial direction. Thus, roller assemblies 18, 20 will cooperate to eliminate rubbing or wear that might otherwise occur between the tubing wall (not shown) and any portion of the surface of body member 12 lying in a radial direction falling between the perpendicularly disposed roller assemblies 18, 20.

It is understood, of course, that one or more additional axially spaced roller assemblies can also be used in the apparatus of the invention, in which case the circumferential spacing would desirably be adjusted so as to separate the roller assemblies evenly around the 360 degree circumference of body member 12. The number of such roller assemblies which can be used will be limited, however, by factors such as the length of each roller assembly, the axial distance between them, the strength of body member 12, and the maximum acceptable length for sucker rod coupling 10.

The portions of body member 12 where roller assemblies 18, 20 are to be installed are preferably machined, cast or otherwise created to form a cross-sectional profile as shown and described with reference to roller assembly 20 in FIGS. 1 and 2. Referring to FIG. 2, portions of a cylindrical section of body member 12 are preferably removed by machining from outside surface 38 to form opposed recesses defined by longitudinal surfaces 28, 52, transverse end surfaces 40, 54, side walls 30, 56, and roller guide 24. Spaces 14 as shown in FIG. 1 extend through body member 12 at each end of roller guide 24 to permit roller assembly 20 to move around roller guide 24 whenever roller assembly 20 comes in contact with a section of the tubing wall while the sucker rod string is moving in either an upward or downward direction. Similarly, it is understood that roller guide 22 of roller assembly 18 as shown in FIG. 1 corresponds to roller guide 24 of roller assembly 20 as shown in FIG. 2.

Roller guide 24 preferably further comprises roller guide track 26, which is shown in FIG. 2 as a slightly arcuate depression in the outwardly facing surfaces of roller guide 24. Roller guide track 26 is adapted to help maintain rollers 42 in their preferred alignment with roller guide 24 as roller assembly 20 revolves around roller guide 24 and thereby provide line contact between the rollers and roller guide 24. Referring to FIG. 1, guide slugs 45, 48 are preferably provided at each end of roller guide 22 to facilitate the passage of roller assembly 18 around the ends of roller guide 22.

Guide slugs 45, 48 can be semi-cylindrical. Referring for illustrative purposes to FIG. 3, it is seen that guide slugs 45, 48 are preferably semi-cylindrical sections having a slight arcuate depression generally corresponding to the arcuate depression as shown for roller guide track 26 in FIG. 2. Guide slugs 45, 48 are preferably placed at the top and bottom ends of roller guide 22 prior to installing roller assembly 18 around roller guide 22. The flat, downwardly facing surface of guide slug 45 as shown in FIG. 3 is placed in facing and contacting relation with the upwardly facing end of roller guide 22 as shown in FIG. 1. Once roller assembly 18 is installed around roller guide 22 and guide slugs 45, 48, guide slugs 45, 48 are held in place by the roller assembly and the walls of body member 12. If desired, however, guide slugs 45, 48 can also be secured to roller guide 22 by welding or by any similarly effective means. Guide slugs not visible in FIG. 1 are also preferably utilized at each end of roller guide 24, where they are likewise held in place by roller assembly 20.

It is understood, of course that the need for separate guide slugs 45, 48 can be avoided by lengthening roller guides 22, 24 and machining sections with a suitable curvature directly onto the ends of the roller guides. Alternatively, instead of roller guides 22, 24 being machined out of cylindrical stock or otherwise formed as shown in FIGS. 1 and 2, they can be separately manufactured and pinned or otherwise secured into appropriately sized slots within body member 12.

While the apparatus of the invention is described herein in its preferred embodiment as a sucker rod coupling; it is understood that the friction-reducing device of the invention is also suitable for reducing friction between any well conduit and a well tool tool or other deviced passed axially through the well conduit. Such devices can be useful, for example, when used in wireline tool strings, with well logging equipment, and the like, as well as when used in a sucker rod coupling.

Other alterations and modifications of the invention disclosed herein will become apparent to those of ordinary skill in the art upon reading this disclosure, and it is intended that the scope of the invention be limited only by the broadest interpretation of the appended claims to which the inventor is legally entitled.

I claim:

1. A sucker rod coupling adapted to reduce friction within production tubing in a well bore, said coupling comprising a substantially cylindrical body member and a plurality of roller assemblies;

said body member comprising means at each end thereof for attaching said coupling to a sucker rod, and a plurality of axially and circumferentially spaced recesses, each recess containing a roller guide connected to said body, and each recess being further adapted to receive and support a roller assembly around said roller guide in such manner that said roller assembly can revolve around said roller guide;

said roller assemblies each comprising a plurality of rollers rotatably mounted on and linked by a chain, said rollers being adapted to reduce frictional contact between said body member and said tubing by rotating between said roller guide and said tubing while said chain revolves around said roller guide.

2. The sucker rod coupling of claim 1 wherein said roller guide further comprises a roller guide track.

3. The sucker rod coupling of claim 1 wherein a guide slug is provided at each end of said roller guide.

4. The sucker rod coupling of claim 3 wherein said guide slug further comprises a roller guide track.

5. The sucker rod coupling of claim 1 wherein said body comprises two axially spaced recesses adapted to receive roller assemblies, and said recesses are perpendicularly disposed in the radial direction.

6. The sucker rod coupling of claim 1 wherein said roller guide is an unitary part of said body member.

7. A device adapted to reduce friction between a well conduit and a well tool passed axially through said well conduit, said device comprising a substantially cylindrical body member and a plurality of roller assemblies;

said body member comprising means at each end thereof for attaching said device to a well tool, and a plurality of axially and circumferentially spaced recesses, each recess containing a roller guide connected to said body, and each recess being further adapted to receive and support a roller assembly around said roller guide in such manner that said roller assembly can revolve around said roller guide;

said roller assemblies each comprising a plurality of rollers rotatably mounted on and linked by a chain, said rollers being adapted to reduce frictional contact between said body member and said conduit by rotating between said roller guide and said conduit while said chain revolves around said roller guide.

8. The device of claim 7 wherein said roller guide further comprises a roller guide track.

9. The device of claim 7 wherein a guide slug is provided at each end of said roller guide.

10. The device of claim 9 wherein said guide slug further comprises a roller guide track.

11. The device of claim 7 wherein said body comprises two axially spaced recesses adapted to receive roller assemblies, and said recesses are perpendicularly disposed in the radial direction.

12. The device of claim 7 wherein said roller guide is an unitary part of said body member.

* * * * *